US011986118B2

(12) United States Patent
Huang

(10) Patent No.: US 11,986,118 B2
(45) Date of Patent: May 21, 2024

(54) BRACKET STRUCTURE AND METHOD OF USING THE BRACKET STRUCTURE

(71) Applicant: SAN HSIN PLASTECH CO., LTD., Taoyuan (TW)

(72) Inventor: Shu-Yuan Huang, Taoyuan (TW)

(73) Assignee: SAN HSIN PLASTECH CO., LTD., Taoyuan (TW)

( * ) Notice: Subject to any disclaimer, the term of this patent is extended or adjusted under 35 U.S.C. 154(b) by 212 days.

(21) Appl. No.: 17/842,739

(22) Filed: Jun. 16, 2022

(65) Prior Publication Data

US 2023/0404311 A1 Dec. 21, 2023

(51) Int. Cl.
*A47H 1/14* (2006.01)

(52) U.S. Cl.
CPC ..... *A47H 1/14* (2013.01)

(58) Field of Classification Search
CPC ..... A47H 1/14; A47H 1/04
USPC ..... 248/262
See application file for complete search history.

(56) References Cited

U.S. PATENT DOCUMENTS 4,878,528 A * 11/1989 Kobayashi ..... E06B 9/323 160/902
5,667,178 A * 9/1997 Yang ..... A47H 1/14 160/902
6,357,079 B1 * 3/2002 Hsu ..... A47H 1/14 248/262
6,375,140 B1 * 4/2002 Shen ..... E06B 9/323 160/368.1
2017/0058598 A1 * 3/2017 Chang ..... E06B 9/307
2019/0063148 A1 * 2/2019 Chiang Huang ..... E06B 9/322

FOREIGN PATENT DOCUMENTS

CN 211673673 U * 10/2020
GB 2415887 A * 1/2006 ..... E06B 3/80
GB 2566090 A * 3/2019 ..... E06B 9/323
JP 2021189193 A * 12/2021
TW M561475 U 6/2018

* cited by examiner

*Primary Examiner* — Kimberly T Wood
(74) *Attorney, Agent, or Firm* — Li & Cai Intellectual Property Office

(57) ABSTRACT

A bracket structure and a method of using the bracket structure are provided. The bracket structure includes a bracket body and a locking plate. The top plate and the rear plate of the bracket body respectively form an upper hook portion and a lower hook portion. The locking plate is movably disposed on the top plate of the bracket body. The locking plate has a locking plate body and a control part, and the locking plate body has a first and a second pressing abutting portion. The upper track is placed between the top plate and the rear plate, so that the bottom of the upper track is placed on the lower hook portion, and the first hook portion of the upper track and the upper hook portion of the bracket body are hooked to each other to temporarily fix the upper track on the bracket structure.

12 Claims, 15 Drawing Sheets

BRACKET STRUCTURE AND METHOD OF USING THE BRACKET STRUCTURE

FIELD OF THE DISCLOSURE

The present disclosure relates to a bracket structure, and more particularly to a bracket structure configured to fix an upper track of an electric curtain and a method of using the bracket structure.

BACKGROUND OF THE DISCLOSURE

In the related art, the prior electric curtain has an upper track, and the upper track has an electric motor disposed therein, a transmission tube body and a cord wrap, etc., and the electric motor can be used to drive the transmission tube body and the cord wrap to rotate, so that the cord wrap can be used to wind up the rope to raise and lower the curtain blades. The cord wrap can also be used to wind up the ladder rope to adjust the inclination angle of the curtain blades so as to adjust the projection angle of the input light. The upper track must be supported and installed on the building by a bracket, and most of the prior brackets have problems such as complicated structure and inconvenient operation.

The applicant once proposed a bracket structure (Taiwan patent publication No. TWM561475), the bracket structure is composed of a bracket body and a locking plate, which has a simplified structure, convenient operation, and small installation and operation space. However, when the bracket structure is fixed on the upper track of the electric curtain, if the rear side of the upper track swings and deforms, the bracket structure and the upper track may become loose. In addition, the bracket body must be provided with a guide rod to cooperate with the guide groove of the locking plate to form a guide mechanism. The manufacture and assembly of the guide rod are more troublesome, so it is inconvenient to manufacture the guide rod.

SUMMARY OF THE DISCLOSURE

In response to the above-referenced technical inadequacies, the present disclosure provides a bracket structure and a method of using the bracket structure. The manufacture and assembly of the bracket structure are relatively simple and easy, which is convenient for production and manufacture, and can avoid the swinging deformation of the rear side of the upper track, so that the bracket structure can be more stably arranged on the upper track.

In one aspect, the present disclosure provides a bracket structure which is configured to be installed on an upper track of an electric curtain. The upper track has a first hook portion and a second hook portion respectively disposed on two upper sides thereof, the upper track has a convex rib disposed on a bottom portion thereof, and the bracket structure includes a bracket body and a locking plate. The bracket body has a top plate and a rear plate. The rear plate is connected to one end of the top plate, the rear plate extends downward from the end of the top plate, another end of the top plate away from the rear plate extends to form an upper hook portion, the rear plate has a lower hook portion disposed on a lower end thereof, two first side plates are respectively connected with two sides of the top plate, the two first side plates are formed by bending and extending downward from the two sides of the top plate, each of the two first side plates has a guide portion integrally formed thereon, and the guide portion protrudes from the first side plate. The locking plate is movably disposed on the top plate of the bracket body. The locking plate has a locking plate body and a control part, the locking plate body includes two rod bodies, the two rod bodies are spaced apart from each other, the control part is connected to one end of each of the two rod bodies, the two rod bodies slidably contact the two first side plates of the bracket body, each of the two rod bodies has a guide groove, the guide portion and the guide groove slidably match with each other so as to form a guiding mechanism, one of the two rod bodies has a first pressing abutting portion disposed on a bottom thereof and disposed adjacent to the control part, another one of the two rod bodies has a second pressing abutting portion disposed on a bottom thereof and disposed away from the control part, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical. The upper track is able to be placed between the top plate and the rear plate of the bracket body, so that a bottom of the upper track is placed on the lower hook portion of the bracket body. A bottom protruding rib of the upper track and the lower hook portion of the bracket body are hooked with or abutted against each other, and the first hook portion of the upper track and the upper hook portion of the bracket body are hooked with each other, so that the upper track is temporarily fixed on the bracket structure. In which, when the locking plate is pushed toward the bracket body, the first pressing abutting portion and the second pressing abutting portion of the locking plate are respectively pressed against the first hook portion and the second hook portion of the upper track so as to fix the upper track on the bracket structure, and the pressing edge is able to be pressed against a front edge of the second hook portion of the upper track.

In certain embodiments, an inner edge of the second hook portion has a highest point, the highest point is located at a highest position of the inner edge of the second hook portion, and the pressing edge extends downward to a position lower than the highest point of the inner edge of the second hook portion.

In certain embodiments, two second side plates are respectively connected with two sides of the rear plate, the two second side plates are formed by bending and extending forward from the two sides of the rear plate, each of the two second side plates has a first bump disposed adjacent to a lower portion thereof, the first bump is spaced apart from the rear plate, and two sides of the adjustment seat are limited between the first bump and the rear plate.

In certain embodiments, the two first bumps are integrally formed with the two second side plates, respectively.

In certain embodiments, the locking plate is movably disposed between the top plate and the two first side plates of the bracket body, the two rod bodies slidably contact two inner edges of the two first side plates of the bracket body, the top plate has two second bumps disposed at a bottom thereof and respectively adjacent to the two first side plates, the second bump is spaced apart from the first side plate, and the rod body is limited between the second bump and the first side plate.

In certain embodiments, the two second bumps are integrally formed with the top plate.

In certain embodiments, the lower hook portion is formed on an adjustment seat, and the adjustment seat is adjustably disposed on the lower end of the rear plate according to a height of the upper track.

In certain embodiments, the adjustment seat has at least one adjustment slot formed thereon, the adjustment slot extends along a height direction of the adjustment seat, at least one fixing screw is screwed on a lower portion of the rear plate, and the at least one fixing screw fits in the adjustment slot. After the adjustment seat is adjusted upwardly or downwardly, the at least one fixing screw is tightened to press and fix the adjustment seat.

In certain embodiments, two second side plates are respectively connected with two sides of the rear plate, the two second side plates are formed by bending and extending forward from the two sides of the rear plate, the adjustment seat is located between the two second side plates, two sides of the adjustment seat are able to be abutted against the two second side plates, and the two second side plates are able to be used to limit the adjustment seat.

In certain embodiments, the lower hook portion is bent inward or bent inward and upward to form a hook shape.

In another aspect, the present disclosure provides a method of using a bracket structure, including the steps of: providing the bracket structure, in which the bracket structure includes a bracket body and a locking plate, the bracket body has a top plate and a rear plate, the rear plate is connected to one end of the top plate, the rear plate extends downward from the end of the top plate, another end of the top plate away from the rear plate extends to form an upper hook portion, the rear plate has a lower hook portion disposed on a lower end thereof, two first side plates are respectively connected with two sides of the top plate, the two first side plates are formed by bending and extending downward from the two sides of the top plate, each of the two first side plates has a guide portion integrally formed thereon, the guide portion protrudes from the first side plate, the locking plate is movably disposed on the top plate of the bracket body, the locking plate has a locking plate body and a control part, the locking plate body includes two rod bodies, the two rod bodies are spaced apart from each other, the control part is connected to one end of each of the two rod bodies, the two rod bodies slidably contact the two first side plates of the bracket body, each of the two rod bodies has a guide groove, the guide portion and the guide groove slidably match with each other so as to form a guiding mechanism, one of the two rod bodies has a first pressing abutting portion disposed on a bottom thereof and disposed adjacent to the control part, another one of the two rod bodies has a second pressing abutting portion disposed on a bottom thereof and disposed away from the control part, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical; pushing the locking plate to move horizontally in a direction away from the bracket body, and adjusting the bracket structure to a released state; placing an upper track of an electric curtain between the top plate and the rear plate of the bracket body, so that a bottom of the upper track is placed on the lower hook portion of the bracket body, a bottom protruding rib of the upper track and the lower hook portion of the bracket body is hooked with or abutted against each other, the first hook portion of the upper track and the upper hook portion of the bracket body is hooked with each other, the upper track is temporarily fixed on the bracket structure, and the upper track is moved and adjusted leftward or rightward to a predetermined position; and pushing the locking plate toward the bracket body, so that the first pressing abutting portion and the second pressing abutting portion of the locking plate are respectively pressed against the first hook portion and the second hook portion of the upper track, the bracket structure is surely engaged with the upper track so as to fix the upper track on the bracket structure, and the pressing edge is able to be pressed against a front edge of the second hook portion of the upper track.

In certain embodiments, an inner edge of the second hook portion has a highest point, the highest point is located at a highest position of the inner edge of the second hook portion, and the pressing edge extends downward to a position lower than the highest point of the inner edge of the second hook portion.

The beneficial effect of the present disclosure is that, in the bracket structure provided by the present disclosure and a method of using the same, and the bracket structure includes a bracket body and a locking plate. Two sides of the top plate of the bracket body are respectively connected with two first side plates, and each of the first side plates is integrally formed with a guide portion. The locking plate has a locking plate body and a control part. The locking plate body includes two rod bodies, and each of the two rod bodies has a guide groove. The guide portion and the guide groove slidably match with each other so as to form a guiding mechanism, which can be used to guide the locking plate to stably move on the bracket body. The guide portion of the present disclosure is integrally formed on the first side plate, and the manufacture and assembly are relatively simple and easy so as to facilitate the production and the manufacture of the present disclosure.

Moreover, one of the two rod bodies has a first pressing abutting portion disposed on a bottom thereof, another one of the two rod bodies has a second pressing abutting portion disposed on a bottom thereof, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical. The pressing edge 213 can press against the front edge of the second hook portion 102 of the upper track 100 so as to prevent the rear side of the upper track 100 from swinging and deforming, so that the bracket structure can be more stably arranged on the upper track.

In addition, the lower hook portion of the present disclosure can be formed on an adjustment seat, the adjustment seat is adjustably (upward or downward) disposed on the lower end of the rear plate, so that the rear plate and the lower hook portion can be telescopically adjusted to each other according to the height of different upper tracks, thereby increasing the suitability of the bracket structure.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
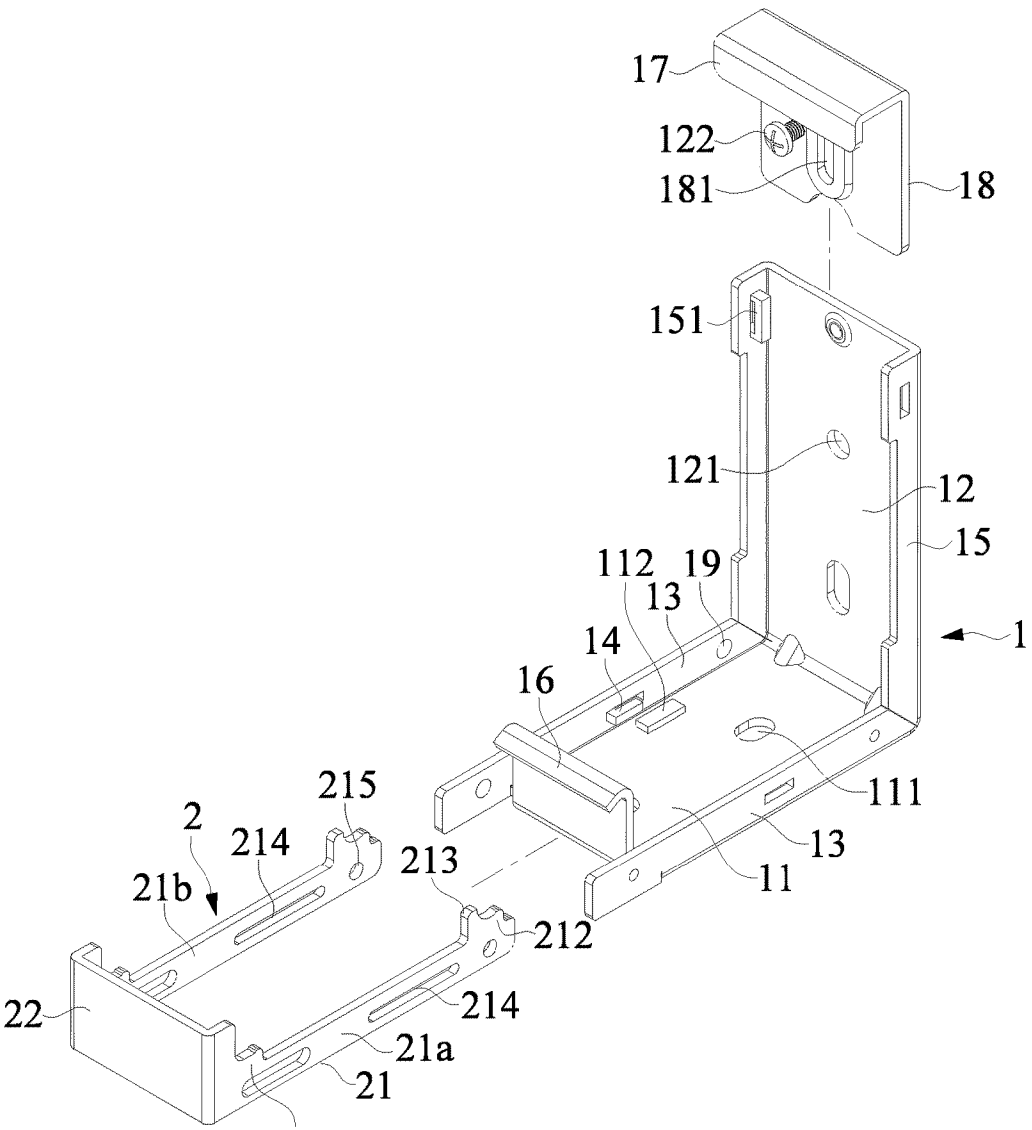
FIG. 1 is an exploded perspective view of a bracket structure according to a first embodiment of the present disclosure.
Figure 2:
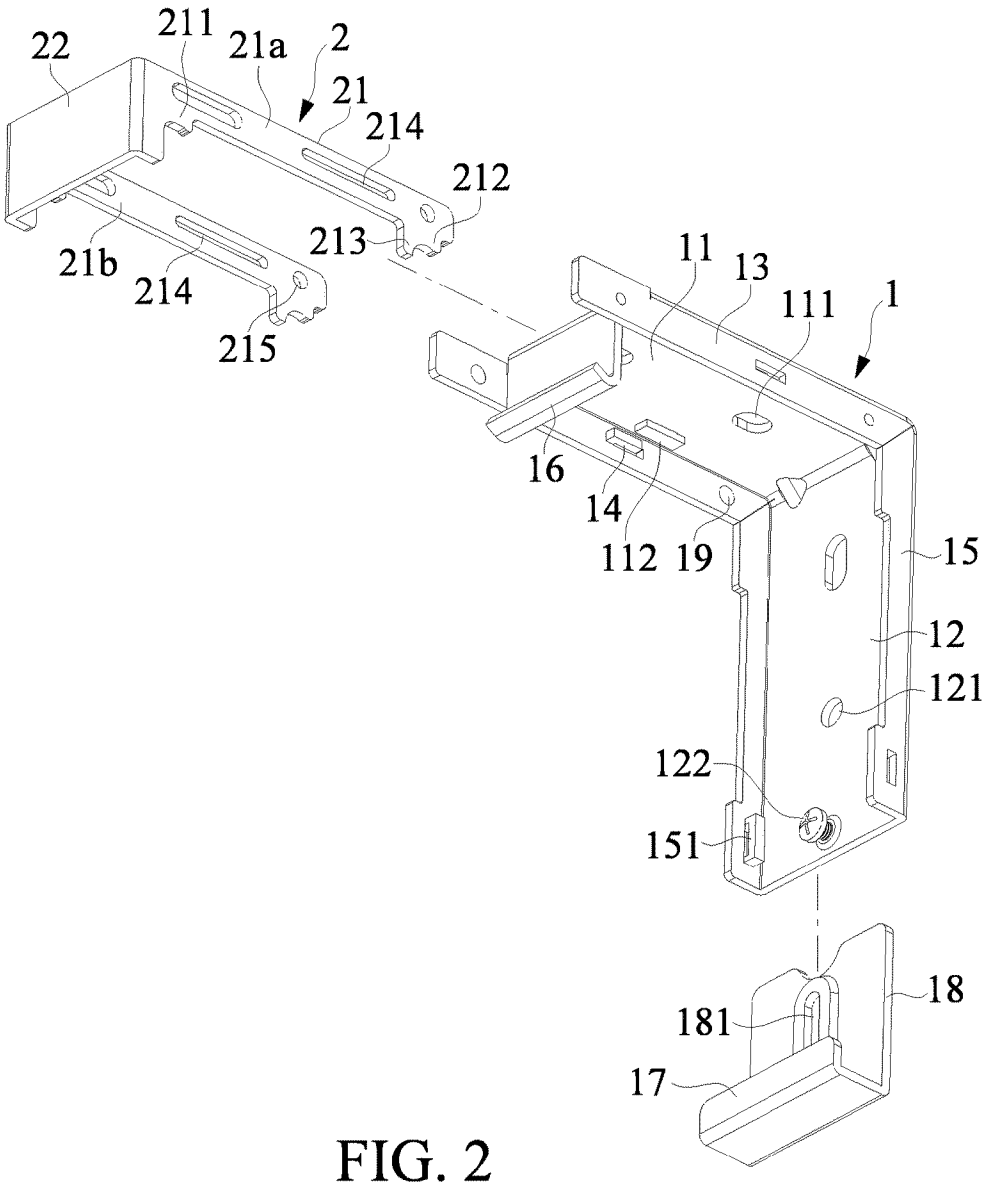
FIG. 2 is another exploded perspective view of the bracket structure according to the first embodiment of the present disclosure.
Figure 3:
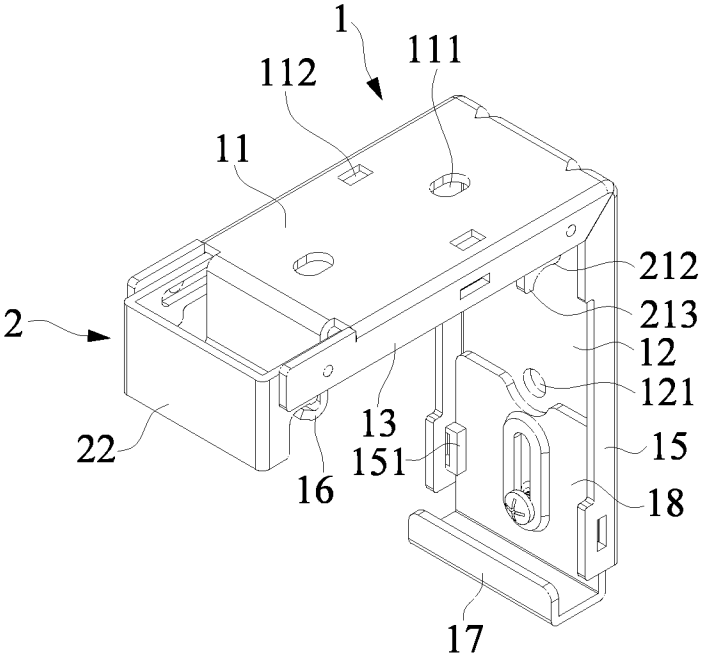
FIG. 3 is a perspective view of the bracket structure according to the first embodiment of the present disclosure.
Figure 4:
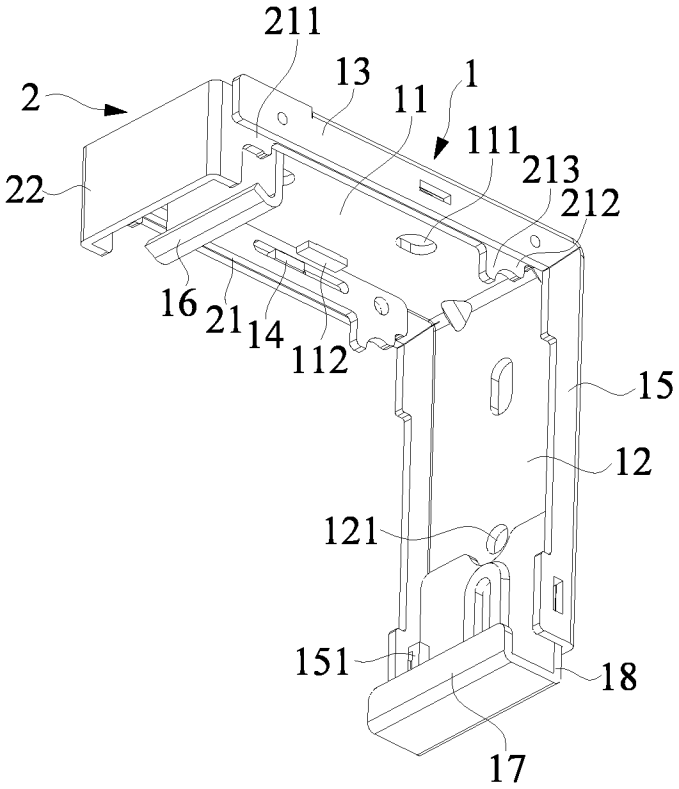
FIG. 4 is another perspective view of the bracket structure according to the first embodiment of the present disclosure.
Figure 5:
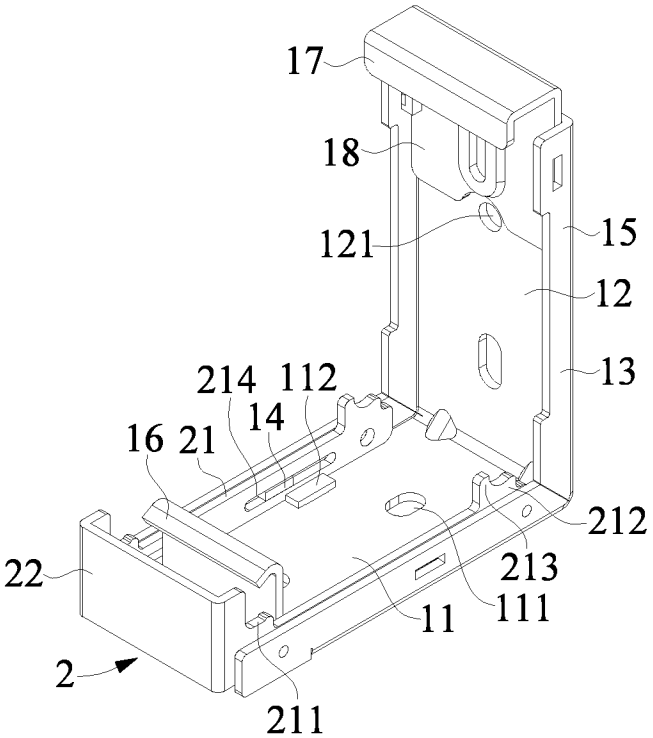
FIG. 5 is yet another perspective view of the bracket structure according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

EMBODIMENTS

Figure 6:
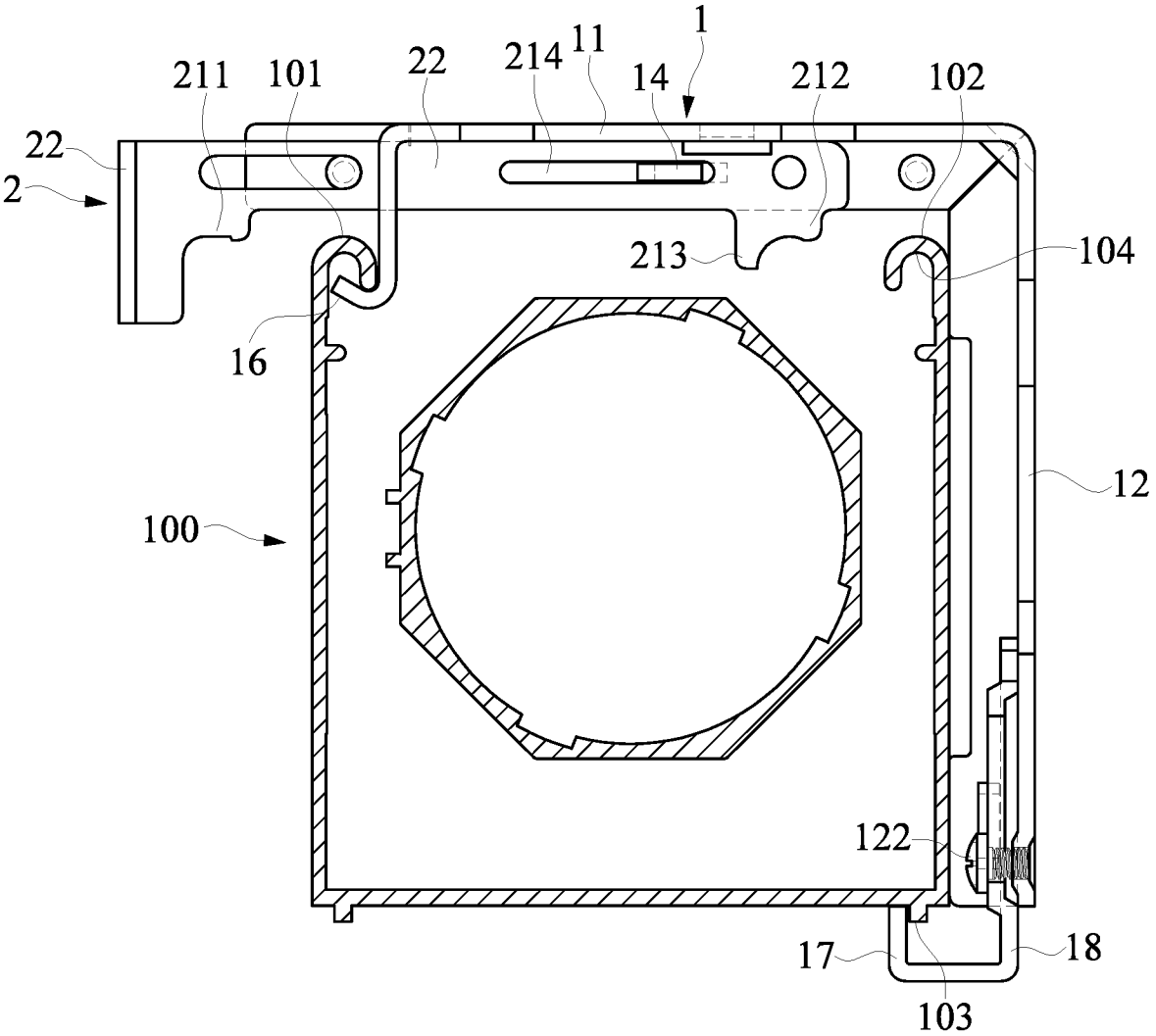
FIG. 6 is a cross-sectional view of the bracket structure and an upper track in a released state according to the first embodiment of the present disclosure.
Figure 7:
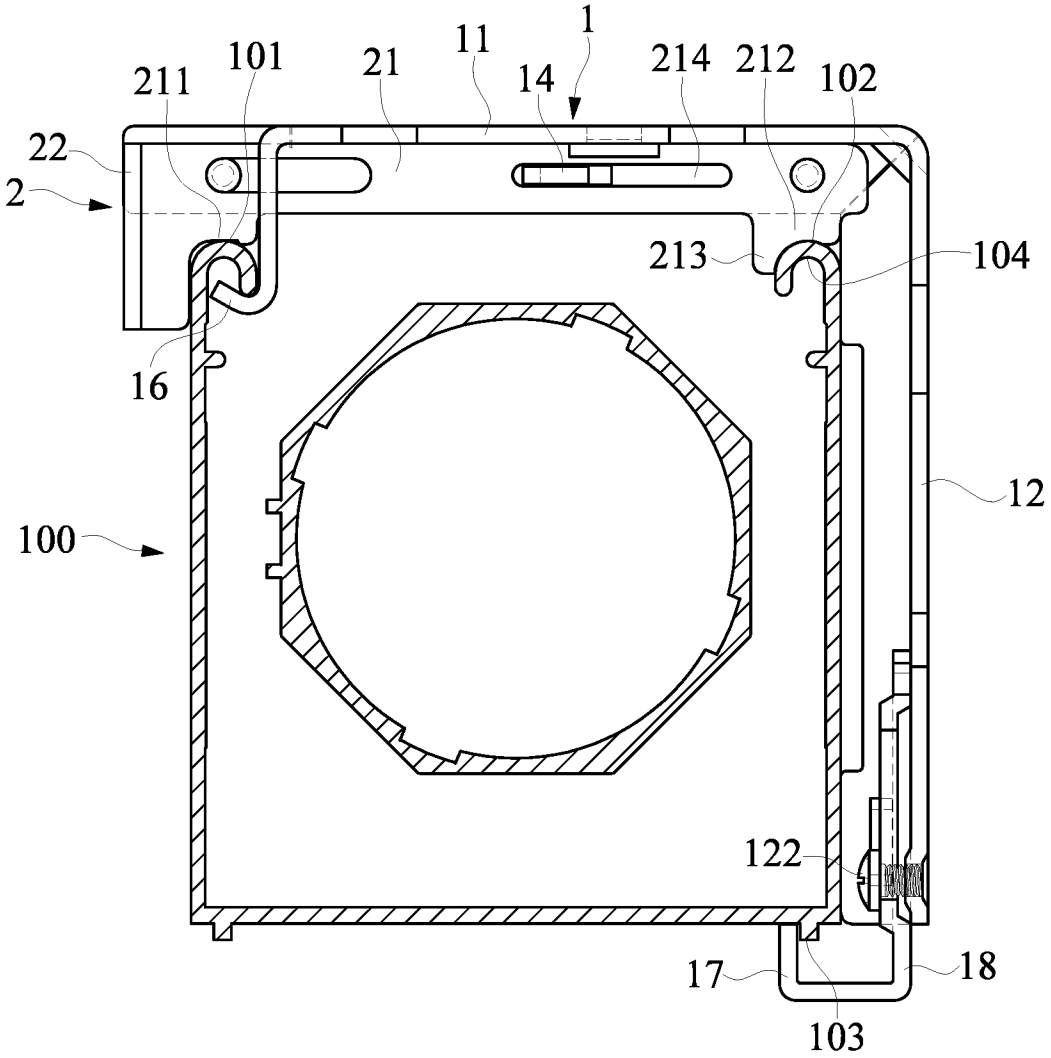
FIG. 7 is a cross-sectional view of the bracket structure and the upper track in a pressed state according to the first embodiment of the present disclosure.
Figure 8:
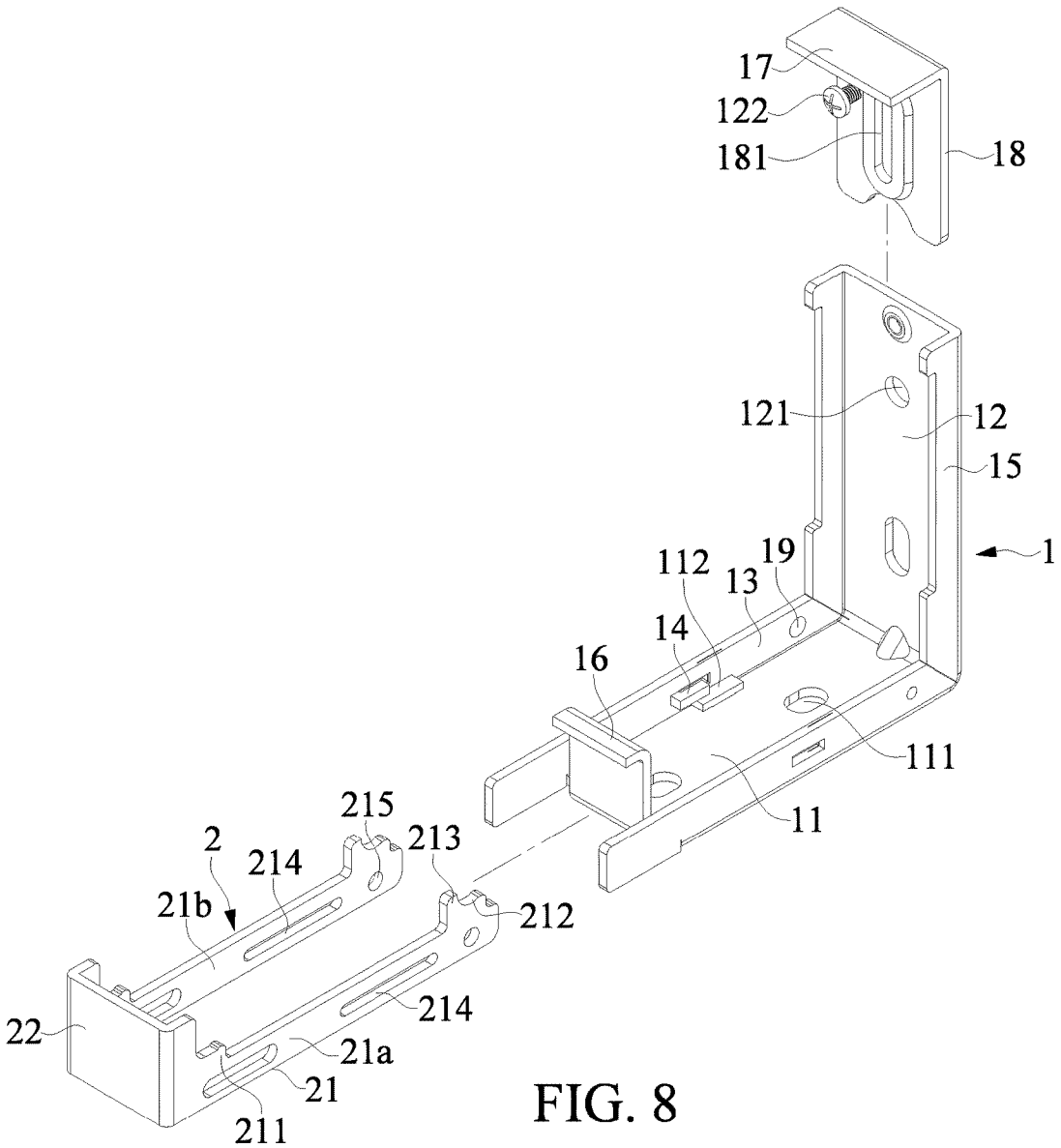
FIG. 8 is an exploded perspective view of the bracket structure according to a second embodiment of the present disclosure.
Figure 9:
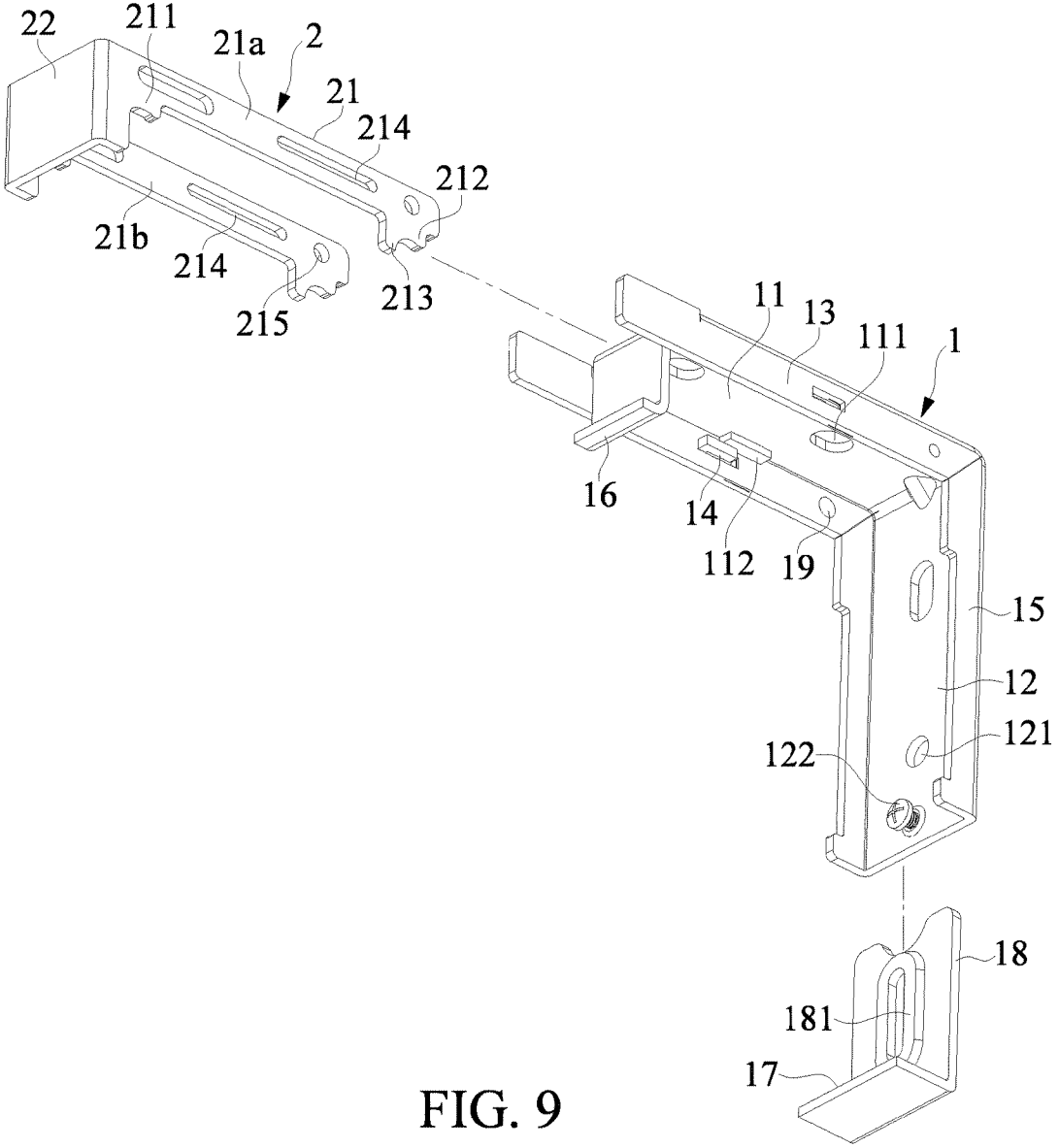
FIG. 9 is another exploded perspective view of the bracket structure according to the second embodiment of the present disclosure.
Figure 10:
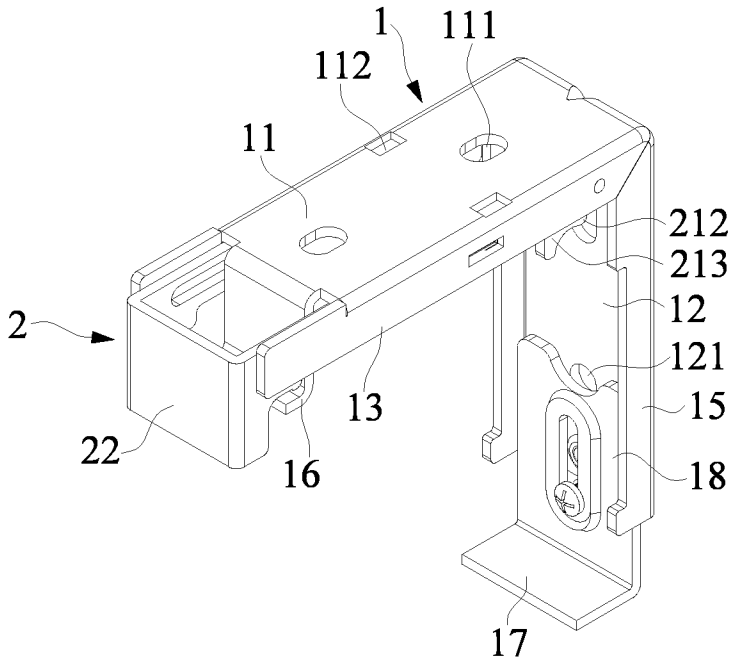
FIG. 10 is a perspective view of the bracket structure according to the second embodiment of the present disclosure.
Figure 11:
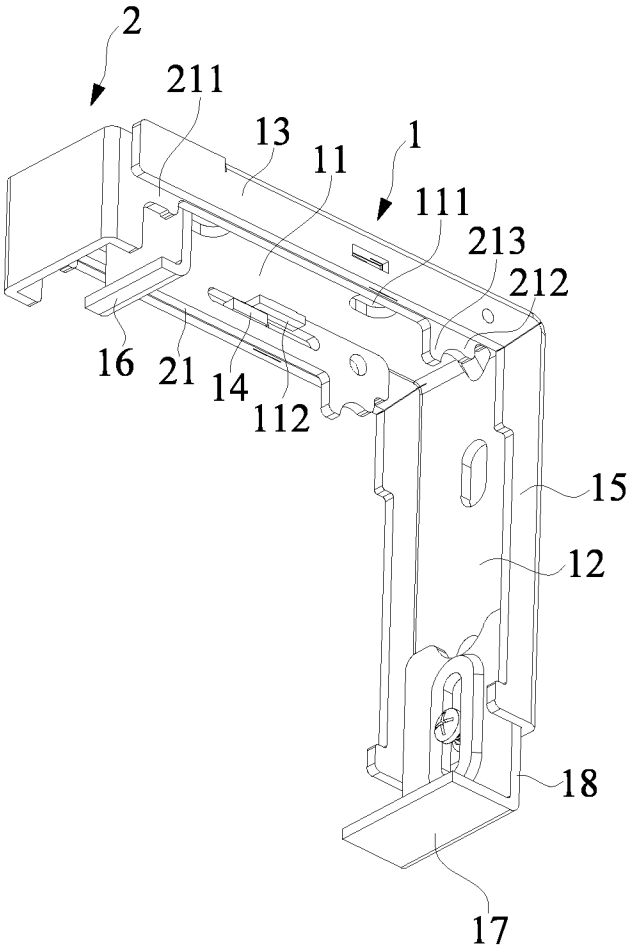
FIG. 11 is another perspective view of the bracket structure according to the second embodiment of the present disclosure.
Figure 12:
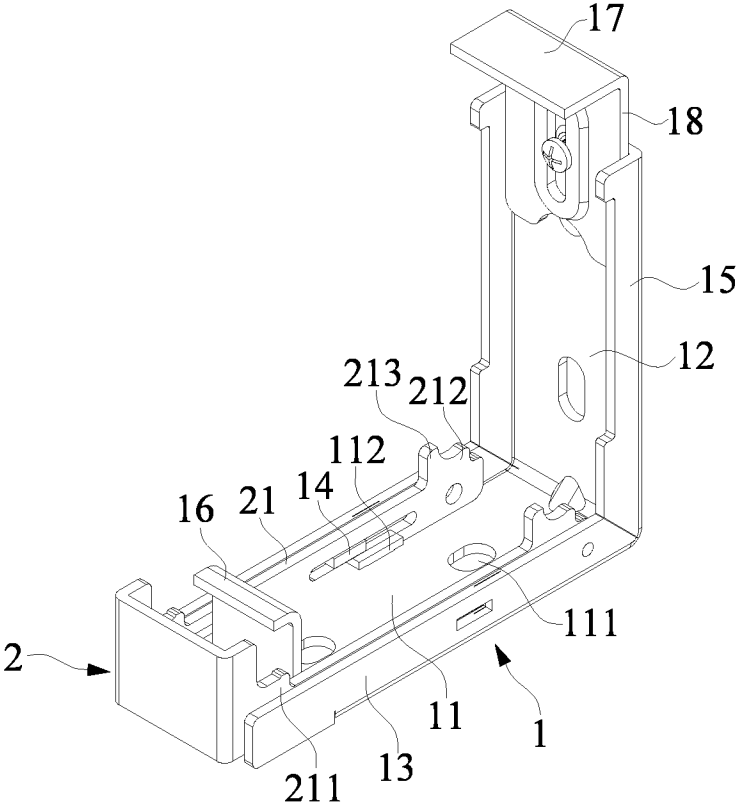
FIG. 12 is yet another perspective view of the bracket structure according to the second embodiment of the present disclosure.
Figure 13:
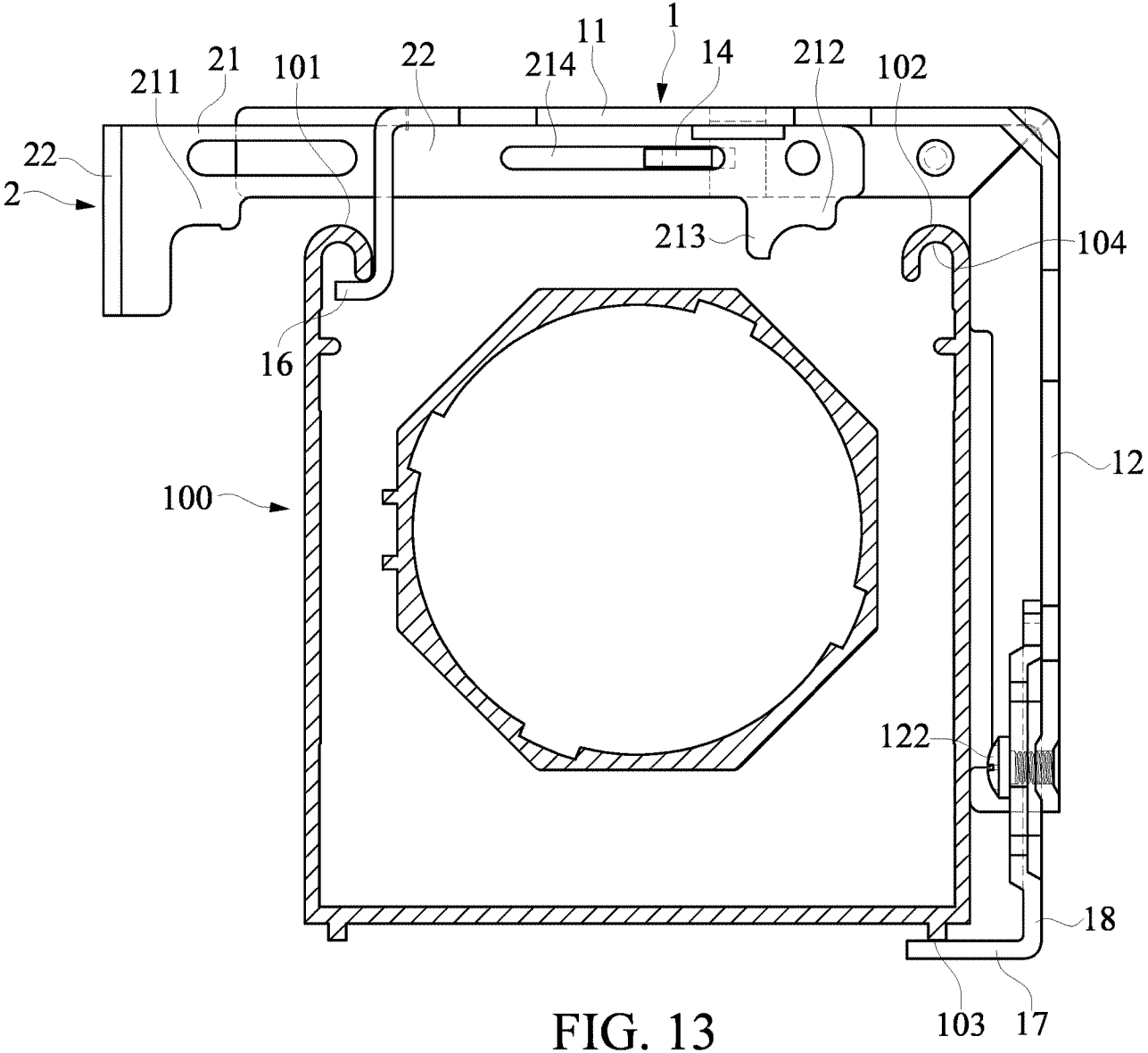
FIG. 13 is a cross-sectional view of the bracket structure and the upper track in the released state according to the second embodiment of the present disclosure.
Figure 14:
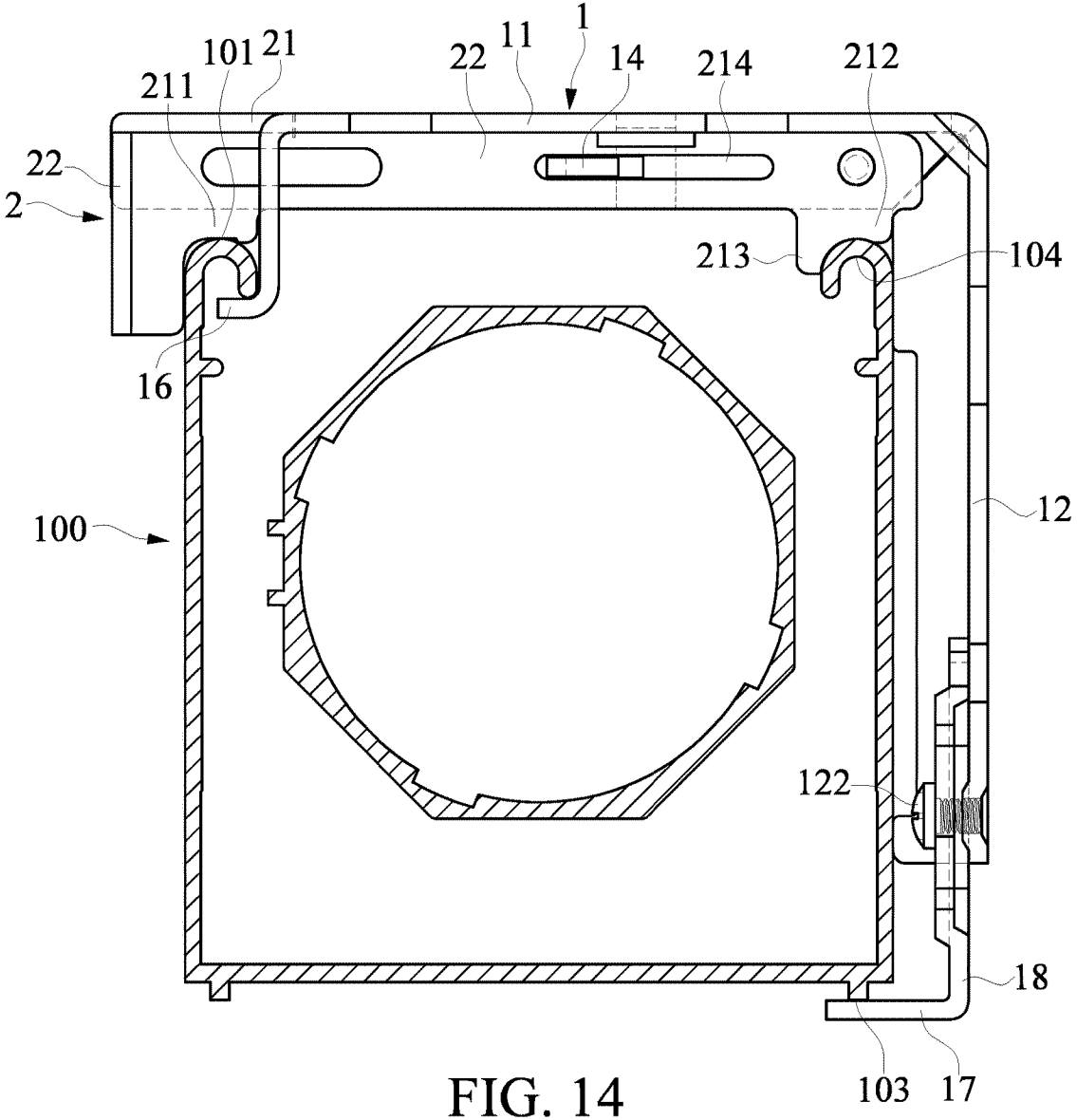
FIG. 14 is a cross-sectional view of the bracket structure and the upper track in the pressed state according to the second embodiment of the present disclosure.

Please refer to FIG. 1 to FIG. 5, the present disclosure provides a bracket structure, which can be configured to be installed on an upper track 100 of an electric curtain (as shown in FIG. 6 and FIG. 7), and the upper track 100 is substantially a square seat. The upper track 100A has a first hook portion 101 and a second hook portion 102 respectively disposed on two upper ends thereof, and the first hook portion 101 and the second hook portion 102 are bent in an arc shape toward the interior of the upper track 100. The upper track 100 has a convex rib 103 disposed on a bottom portion thereof, and the convex rib 103 can be close to a rear side of the upper track 100.

The bracket structure includes a bracket body 1 and a locking plate 2. The bracket body 1 can be made of metal material. The bracket body 1 has a top plate 11 and a rear plate 12. The top plate 11 can be a square plate body, and the top plate 11 can be disposed horizontally. The rear plate 12 is connected to one end (a rear end) of the top plate 11, the rear plate 12 extends downward from one end of the top plate 11, the rear plate 12 can be disposed in an upright shape, and the top plate 11 and the rear plate 12 can be perpendicular to each other. The top plate 11 and the rear plate 12 are respectively provided with a first fixing hole 111 and a second fixing hole 121, so that the top plate 11 and the rear plate 12 can be fixed to the ceiling and wall of the building by using fasteners such as screws.

Two first side plates 13 are respectively connected with two sides of the top plate 11, and the two first side plates 13 can be formed by bending and extending downward from the two sides of the top plate 11. Each of the two first side plates 13A has a guide portion 14 integrally formed thereon. The guide portion 14 can be formed by punching the first side plate 13, and the guide portion 14 protrudes from the inner side of the first side plate 13. Preferably, the guide portion 14 is spaced apart from the top plate 11, and the guide portion 14 can extend along a horizontal direction by a predetermined length. Two second side plates 15 are respectively connected with two sides of the rear plate 12, and the two second side plates 15 can be formed by bending and extending forward from the two sides of the rear plate 12. The first side plate 13 and the second side plate 15 can be used to increase the strength of the bracket body 1.

One end (a front end) of the top plate 11 away from the rear plate 12 extends to form an upper hook portion 16. The upper hook portion 16 can be formed by extending downward from one end of the top plate 11, and the lower end of the upper hook portion 16 is bent outward and upward to form a hook shape. The rear plate 12 has a lower hook portion 17 disposed on a lower end thereof, and the lower hook portion 17 is bent inward and upward to form a hook shape. Preferably, the lower hook portion 17 is formed on an adjustment seat 18, and the adjustment seat 18 is adjustably (upward or downward) disposed on the lower end of the rear plate 12, so that the rear plate 12 and the lower hook portion 17 can be telescopically adjusted to each other according to the height of different upper tracks.

In this embodiment, at least one adjustment slot 181 is formed on the adjustment seat 18, the adjustment slot 181 extends along a height direction of the adjustment seat 18, at least one fixing screw 122 is screwed on a lower portion of the rear plate 12, and the at least one fixing screw 122 fits in the adjustment slot 181. After the adjustment seat 18 is adjusted upwardly or downwardly, the at least one fixing screw 122 can be tightened to press and fix the adjustment seat 18, so that the adjustment seat 18 and the lower hook portion 17 can be fixed at a predetermined height. Preferably, each of the two second side plates 15 has a first bump 151 disposed adjacent to a lower portion thereof. The first bump 151 is spaced apart from the rear plate 12, so that two sides of the adjustment seat 18 can be limited between the first bump 151 and the rear plate 12 so as to guide the adjustment seat 18 to be able to be moved and adjusted stably. Preferably, the two first bumps 151 are integrally formed with the two second side plates 15 respectively, and the two first bumps 151 can be formed by punching the second side plates 15 respectively, so as to facilitate the production of the second side plates 15. Preferably, the adjustment seat 18 is located between the two second side plates 15, the two sides of the adjustment seat 18 can abut against the two second side plates 15, and the two second side plates 15 can be used to limit and guide the adjustment seat 18 so as to guide the adjustment seat 18 to be able to be moved and adjusted stably.

The locking plate 2 can be made of metal material. The locking plate 2 is movably disposed between the top plate 11 and the two first side plates 13 of the bracket body 1. The locking plate 2 has a locking plate body 21 and a control part 22. The locking plate body 21 can be disposed under the top plate 11 of the bracket body 1, the locking plate body 21 includes two rod bodies 21*a* and 21*b*, the two rod bodies 21*a* and 21*b* are spaced apart from each other, the two rod bodies 21*a* and 21*b* can be arranged horizontally, and the two rod bodies 21*a* and 21*b* can be parallel to each other. The control part 22 is connected to one end of each of the two rod bodies 21*a* and 21*b*, so that both the two rod bodies 21*a* and 21*b* are connected to the locking plate body 21 through the control part 22. The outer edges of the two rod bodies 21*a* and 21*b* of the locking plate body 21 can slidably contact the inner edges of the two first side plates 13 of the bracket body 1 so as to guide the locking plate 2 to be stably moved forward and backward. Preferably, the top plate 11 has two second bumps 112 disposed at the bottom thereof and respectively adjacent to the two first side plates 13, the second bump 112 is spaced apart from the first side plate 13, and each of the two rod bodies 21*a* and 21*b* is limited between a corresponding one of the two second bumps 112 and a corresponding one of the two first side plates 13 so as to guide the locking plate 2 to be able to be moved stably. Preferably, the two second bumps 112 are integrally formed with the top plate 11, and the two second bumps 112 can be formed by punching the top plate 11 so as to facilitate the production of the top plate 11.

The rod body 21*a* has a first pressing abutting portion 211 disposed on a bottom thereof, and the rod body 21*b* has a second pressing abutting portion 212 disposed on a bottom thereof. The first pressing abutting portion 211 is disposed adjacent to the control part 22, and the second pressing abutting portion 212 is disposed away from the control part 22. The first pressing abutting portion 211 and the second pressing abutting portion 212 respectively correspond to the first hook portion 101 and the second hook portion 102 of the upper track 100. The first pressing abutting portion 211 and the second pressing abutting portion 212 can be shown as concaved curved surfaces, and the first pressing abutting portion 211 and the second pressing abutting portion 212 can be pressed and retained on the first hook portion 101 and the second hook of the upper track 100, respectively (as shown in FIG. 7).

The second pressing abutting portion 212 extends downward from one side thereof to form a pressing edge 213. That is to say, the pressing edge 213 extends by a predetermined length in a direction away from the second pressing abutting portion 212, the pressing edge 213 is located at the second pressing abutting portion 212 and disposed adjacent to one side of the first pressing abutting portion 211, the pressing edge 213 extends downward by a predetermined length, so that the two sides of the second pressing abutting portion 212 are asymmetrical (as shown in FIG. 6 and FIG. 7) and the pressing edge 213 can provide the function of stopping and limiting, and the pressing edge 213 can press against the front edge of the second hook portion 102 of the upper track 100 so as to prevent the rear side of the upper track 100 from swinging and deforming inwardly (as shown in FIG. 7). In this embodiment, the inner edge of the second hook portion 102 has a highest point 104, the highest point 104 is located at a highest position of the inner edge of the second hook portion 102, and the pressing edge 213 extends downward to a position lower than the highest point 104 to provide a better stop and limit function.

Each of the two rod bodies 21*a* and 21*b* has a guide groove 214. The guide groove 214 extends along a horizontal direction by a predetermined length. The length of the guide groove 214 is greater than the length of the guide portion 14. The guide portion 14 and the guide groove 214 slidably match with each other so as to form a guiding mechanism, which can be configured to guide the locking plate 2 to be stably moved between the top plate 11 and the two first side plates 13 of the bracket body 1.

The control part 22 is connected to one end (a front end) of the locking plate body 21, and the control part 22 can be used to push the locking plate 2 to move horizontally to achieve a pressed state or a released state. In this embodiment, the control part 22 is an upright plate body, and two sides of the control part 22 are respectively connected to two ends of the two rod bodies 21*a* and 21*b*.

In this embodiment, the locking plate 2 is further provided with two locking holes 215, the bracket body 1 has two convex points 19 respectively corresponding to the two locking holes 215, and the two locking holes 215 can be provided on the locking plate body 21 of the locking plate 2, and the two convex points 19 can be disposed on the first side plate 13 of the bracket body 1. When the upper track 100 is installed and the locking plate 2 is pushed toward the bracket body 1, the locking hole 215 and the convex point 19 can be engaged with each other to prevent the locking plate 2 from disengaging (slipping out of the first side plate 13 of the bracket body 1).

As shown in FIG. 6, the locking plate 2 can be pushed to move horizontally in a direction away from the bracket body 1, so that the bracket structure is in a released state. As shown in FIG. 7, the locking plate 2 can be pushed to move horizontally in a direction close to the bracket body 1, so that the bracket structure is in a retained state. Before the upper track 100 of the electric curtain is to be installed on the bracket structure, the bracket structure can be adjusted to the released state in advance (as shown in FIG. 6), and then the upper track 100 of the electric curtain is placed between the top plate 11 and the rear plate 12 of the bracket body, so that the bottom of the upper track 100 can be placed on the lower hook portion 17 of the bracket body 1, the bottom protruding rib 103 of the upper track 100 and the lower hook portion 17 of the bracket body 1 can be hooked (or retained) with or abutted against each other, and the first hook portion 101 of the upper track 100 and the upper hook portion 16 of the bracket body 1 can be hooked with each other. Therefore, the upper track 100 can be temporarily fixed on the bracket structure so as to facilitate construction, and the upper track 100 can be moved or adjusted leftward or rightward to a predetermined position. Then, the locking plate 2 can be pushed toward the bracket body 1 (as shown in FIG. 7), so that the first pressing abutting portion 211 and the second pressing abutting portion 212 of the locking plate 2 can be respectively pressed (abutted) against the first hook portion 101 and the second hook portion 102 of the upper track 100, and the upper track 100 can be confirmed to be engaged with the bracket structure so as to stably fix the upper track 100 on the bracket structure.

Figure 15:
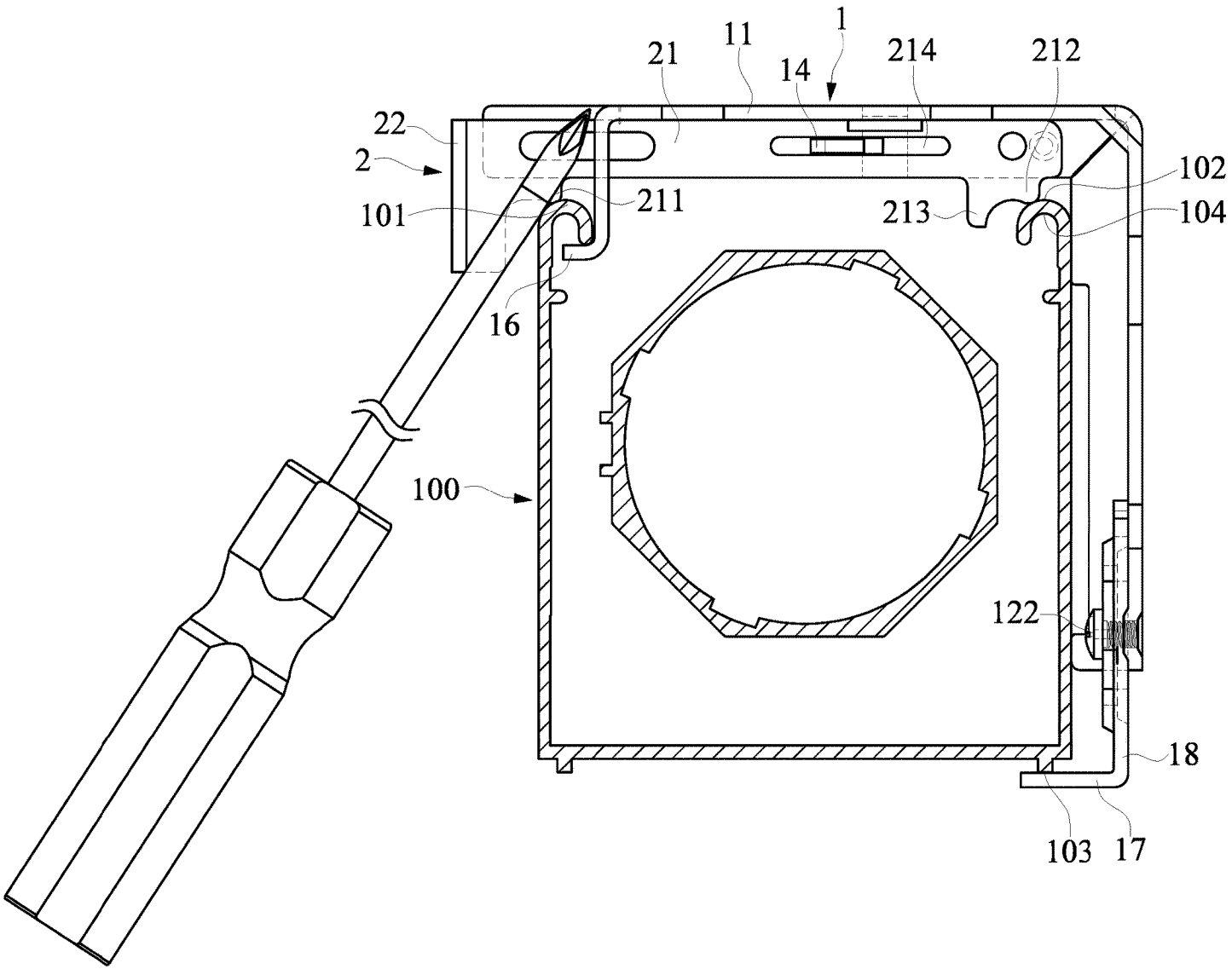
FIG. 15 is a schematic view of the disassembly of the bracket structure of the present disclosure.

Referring to FIG. 8 to FIG. 14, the present disclosure further provides a narrow bracket structure, and the structure of the narrow bracket structure is substantially the same as that of the above-mentioned embodiment. The main difference is that the width of the narrow bracket structure is smaller, so that it can be applied to smaller loads, and in this embodiment, the lower hook portion 17 is bent inward to form a hook shape, the bottom of the upper track 100 can be placed on the lower hook portion 17 of the bracket body 1, and the bottom protruding rib 103 of the upper track 100 and the lower hook portion 17 of the bracket body 1 can be abutted against each other. When the user wants to disassemble the upper track 100 from the bracket body 1, a slender tool (such as a screwdriver) can be inserted into the inner side of the control part 22 of the locking plate 2 (as shown in FIG. 15) so as to lift out and release the locking plate 2. When the locking plate 2 is pushed in a direction away from the bracket body 1, the first pressing abutting portion 211 and the second pressing abutting portion 212 can be separated from the first hook portion 101 and the second hook portion 102 of the upper track 100, so that the upper track 100 and the bracket structure are in a released state in order to remove the upper track 100 easily.

The present disclosure also provides a method for using a bracket structure, which includes the following steps:

Firstly, a bracket structure is provided. The bracket structure includes a bracket body 1 and a locking plate 2 (as shown in FIG. 1 to FIG. 7). The bracket structure is the same as that in the above-mentioned embodiment, so it will not be repeated here.

Then, the locking plate 2 is pushed to move horizontally in the direction away from the bracket body 1, and the bracket structure is adjusted to the released state (as shown in FIG. 6).

Next, the upper track 100 of the electric curtain is placed between the top plate 11 and the rear plate 12 of the bracket body 1, so that the bottom of the upper track 100 is placed on the lower hook portion 17 of the bracket body 1, the bottom protruding rib 103 of the upper track 100 and the lower hook portion 17 of the bracket body 1 can be hooked (or retained) with or abutted against each other, and the first hook portion 101 of the upper track 100 and the upper hook portion 16 of the bracket body 1 can be hooked with each other. Therefore, the upper track 100 can be temporarily fixed on the bracket structure, and the upper track 100 can be moved or adjusted leftward or rightward to a predetermined position.

Then, the locking plate 2 is pushed toward the bracket body 1 (as shown in FIG. 7), so that the first pressing abutting portion 211 and the second pressing abutting portion 212 of the locking plate 2 are respectively pressed against the first hook portion 101 and the second hook portion 102 of the upper track 100, the bracket structure is surely engaged with the upper track 100 so as to fix the upper track 100 on the bracket structure, and the pressing edge 213 can be pressed against the front edge of the second hook portion 102 of the upper track 100. By this way, the upper track 100 of the electric curtain can be installed on the bracket structure.

The bracket structure of the present disclosure has the advantages of simplified structure, convenient operation, no need for special skills, convenient and labor-saving crimping, no need for special tools, and can be assembled and disassembled by one person, and the installation and operation space is small. Furthermore, the bracket structure of the present disclosure has a high bearing capacity, and the hooking method can facilitate the position adjustment of the upper track 100 (that is to say, the upper track 100 can be moved or adjusted leftward or rightward to a predetermined position), and it can be visually judged whether the locking plate is in place after pressing.

Beneficial Effects of the Embodiments

The beneficial effect of the present disclosure is that, in the bracket structure provided by the present disclosure and a method of using the same, the bracket structure includes a bracket body and a locking plate. Two sides of the top plate of the bracket body are respectively connected with two first side plates, and each of the first side plates is integrally formed with a guide portion. The locking plate has a locking plate body and a control part. The locking plate body includes two rod bodies, and each of the two rod bodies has a guide groove. The guide portion and the guide groove slidably match with each other so as to form a guiding mechanism, which can be used to guide the locking plate to stably move on the bracket body. The guide portion of the present disclosure is integrally formed on the first side plate, and the manufacture and assembly are relatively simple and easy so as to facilitate the production and the manufacture of the present disclosure.

Moreover, one of the two rod bodies has a first pressing abutting portion disposed on a bottom thereof, another one of the two rod bodies has a second pressing abutting portion disposed on a bottom thereof, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical. The pressing edge 213 can press against the front edge of the second hook portion 102 of the upper track 100 so as to prevent the rear side of the upper track 100 from swinging and deforming, so that the bracket structure can be more stably arranged on the upper track.

In addition, the lower hook portion of the present disclosure can be formed on an adjustment seat, the adjustment seat is adjustably (upward or downward) disposed on the lower end of the rear plate, so that the rear plate and the lower hook portion can be telescopically adjusted to each other according to the height of different upper tracks, thereby increasing the suitability of the bracket structure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A bracket structure is configured to be installed on an upper track of an electric curtain, wherein the upper track has a first hook portion and a second hook portion respectively disposed on two upper sides thereof, the upper track has a convex rib disposed on a bottom portion thereof, and the bracket structure comprises:

a bracket body having a top plate and a rear plate, wherein the rear plate is connected to one end of the top plate, the rear plate extends downward from the end of the top plate, another end of the top plate away from the rear plate extends to form an upper hook portion, the rear plate has a lower hook portion disposed on a lower end thereof, two first side plates are respectively connected with two sides of the top plate, the two first side plates are formed by bending and extending downward from the two sides of the top plate, each of the two first side plates has a guide portion integrally formed thereon, and the guide portion protrudes from the first side plate; and a locking plate movably disposed on the top plate of the bracket body, wherein the locking plate has a locking plate body and a control part, the locking plate body includes two rod bodies, the two rod bodies are spaced apart from each other, the control part is connected to one end of each of the two rod bodies, the two rod bodies slidably contact the two first side plates of the bracket body, each of the two rod bodies has a guide groove, the guide portion and the guide groove slidably match with each other so as to form a guiding mechanism, one of the two rod bodies has a first pressing abutting portion disposed on a bottom thereof and disposed adjacent to the control part, another one of the two rod bodies has a second pressing abutting portion disposed on a bottom thereof and disposed away from the control part, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical;

wherein the upper track is able to be placed between the top plate and the rear plate of the bracket body, so that a bottom of the upper track is placed on the lower hook portion of the bracket body; wherein a bottom protruding rib of the upper track and the lower hook portion of the bracket body are hooked with or abutted against each other, and the first hook portion of the upper track and the upper hook portion of the bracket body are hooked with each other, so that the upper track is temporarily fixed on the bracket structure; wherein, when the locking plate is pushed toward the bracket body, the first pressing abutting portion and the second pressing abutting portion of the locking plate are respectively pressed against the first hook portion and the second hook portion of the upper track so as to fix the upper track on the bracket structure, and the pressing edge is able to be pressed against a front edge of the second hook portion of the upper track.

2. The bracket structure according to claim 1, wherein an inner edge of the second hook portion has a highest point, the highest point is located at a highest position of the inner edge of the second hook portion, and the pressing edge extends downward to a position lower than the highest point of the inner edge of the second hook portion.

3. The bracket structure according to claim 1, wherein two second side plates are respectively connected with two sides of the rear plate, the two second side plates are formed by bending and extending forward from the two sides of the rear plate, each of the two second side plates has a first bump disposed adjacent to a lower portion thereof, the first bump is spaced apart from the rear plate, and two sides of the adjustment seat are limited between the first bump and the rear plate.

4. The bracket structure according to claim 1, wherein the two first bumps are integrally formed with the two second side plates, respectively.

5. The bracket structure according to claim 1, wherein the locking plate is movably disposed between the top plate and the two first side plates of the bracket body, the two rod bodies slidably contact two inner edges of the two first side plates of the bracket body, the top plate has two second bumps disposed at a bottom thereof and respectively adjacent to the two first side plates, the second bump is spaced apart from the first side plate, and the rod body is limited between the second bump and the first side plate.

6. The bracket structure according to claim 1, wherein the two second bumps are integrally formed with the top plate.

7. The bracket structure according to claim 1, wherein the lower hook portion is formed on an adjustment seat, and the adjustment seat is adjustably disposed on the lower end of the rear plate according to a height of the upper track.

8. The bracket structure according to claim 7, wherein the adjustment seat has at least one adjustment slot formed thereon, the adjustment slot extends along a height direction of the adjustment seat, at least one fixing screw is screwed on a lower portion of the rear plate, and the at least one fixing screw fits in the adjustment slot; wherein, after the adjustment seat is adjusted upwardly or downwardly, the at least one fixing screw is tightened to press and fix the adjustment seat.

9. The bracket structure according to claim 1, wherein two second side plates are respectively connected with two sides of the rear plate, the two second side plates are formed by bending and extending forward from the two sides of the rear plate, the adjustment seat is located between the two second side plates, two sides of the adjustment seat are able to be abutted against the two second side plates, and the two second side plates are able to be used to limit the adjustment seat.

10. The bracket structure according to claim 1, wherein the lower hook portion is bent inward or bent inward and upward to form a hook shape.

11. A method of using a bracket structure, comprising the steps of:

providing the bracket structure, wherein the bracket structure includes a bracket body and a locking plate, the bracket body has a top plate and a rear plate, the rear plate is connected to one end of the top plate, the rear plate extends downward from the end of the top plate, another end of the top plate away from the rear plate extends to form an upper hook portion, the rear plate has a lower hook portion disposed on a lower end thereof, two first side plates are respectively connected with two sides of the top plate, the two first side plates are formed by bending and extending downward from the two sides of the top plate, each of the two first side plates has a guide portion integrally formed thereon, the guide portion protrudes from the first side plate, the locking plate is movably disposed on the top plate of the bracket body, the locking plate has a locking plate body and a control part, the locking plate body includes two rod bodies, the two rod bodies are spaced apart from each other, the control part is connected to one end of each of the two rod bodies, the two rod bodies slidably contact the two first side plates of the bracket body, each of the two rod bodies has a guide groove, the guide portion and the guide groove slidably match with each other so as to form a guiding mechanism, one of the two rod bodies has a first pressing abutting portion disposed on a bottom thereof and disposed adjacent to the control part, another one of the two rod bodies has a second pressing abutting portion disposed on a bottom thereof and disposed away from the control part, the second pressing abutting portion extends downward from one side thereof to form a pressing edge, the pressing edge is located at the second pressing abutting portion and disposed adjacent to one side of the first pressing abutting portion, and the pressing edge extends downward by a predetermined length so that two sides of the second pressing abutting portion are asymmetrical;

pushing the locking plate to move horizontally in a direction away from the bracket body, and adjusting the bracket structure to a released state;

placing an upper track of an electric curtain between the top plate and the rear plate of the bracket body, so that a bottom of the upper track is placed on the lower hook portion of the bracket body, a bottom protruding rib of the upper track and the lower hook portion of the bracket body is hooked with or abutted against each other, the first hook portion of the upper track and the upper hook portion of the bracket body is hooked with each other, the upper track is temporarily fixed on the bracket structure, and the upper track is moved and adjusted leftward or rightward to a predetermined position; and pushing the locking plate toward the bracket body, so that the first pressing abutting portion and the second pressing abutting portion of the locking plate are respectively pressed against the first hook portion and the second hook portion of the upper track, the bracket structure is surely engaged with the upper track so as to fix the upper track on the bracket structure, and the pressing edge is able to be pressed against a front edge of the second hook portion of the upper track.

12. The method of using the bracket structure according to claim 11, wherein an inner edge of the second hook portion has a highest point, the highest point is located at a highest position of the inner edge of the second hook portion, and the pressing edge extends downward to a position lower than the highest point of the inner edge of the second hook portion.

* * * * *